US005151053A

United States Patent [19]

Shinji et al.

[11] Patent Number: 5,151,053

[45] Date of Patent: Sep. 29, 1992

[54] ELECTRICAL CONNECTOR FOR SHIELDING CABLE

[75] Inventors: Yasuhisa Shinji; Toshiaki Hasegawa; Shinichi Akune; Hirohiko Sakuhara, all of Shizuoka, Japan

[73] Assignee: Yazaki Corporation, Tokyo, Japan

[21] Appl. No.: 661,974

[22] Filed: Feb. 28, 1991

[30] Foreign Application Priority Data

Mar. 5, 1990 [JP] Japan ..... 2-21476[U]
Aug. 30, 1990 [JP] Japan ..... 2-90067[U]

[51] Int. Cl.[5] ..... H01R 9/03
[52] U.S. Cl. ..... 439/610; 439/98
[58] Field of Search ..... 439/607, 609, 609, 610, 439/92, 95, 96, 98, 108

[56] References Cited

U.S. PATENT DOCUMENTS 3,240,868 3/1966 Ets-Hokin et al. ..... 439/95 X
3,808,353 4/1974 Burtelson ..... 439/96 X
4,397,516 8/1983 Koren et al. ..... 439/610
4,804,338 2/1989 Dibble et al. ..... 439/610 X
4,854,891 8/1989 Kamei et al. ..... 439/610 X
4,921,449 5/1990 Fish ..... 439/610

*Primary Examiner*—Larry I. Schwartz
*Assistant Examiner*—Khiem Nguyen
*Attorney, Agent, or Firm*—Sughrue, Mion, Zinn, MacPeak & Seas

[57] ABSTRACT

A connector at the end of a shielding cable which includes braid wire surrounding individual internal insulated wires enables superior retention of the braid wire when the braid wire is folded back to expose the individual wires. In one embodiment, the braid wire is folded back over a tapered portion, and is held over that portion in press contact. In another embodiment, the braid wire is passed over threads on a tubular body surrounding an outer insulating layer of the shielding cable, and is retained there by an internally-threaded tubular terminal.

2 Claims, 6 Drawing Sheets

ELECTRICAL CONNECTOR FOR SHIELDING CABLE

BACKGROUND OF THE INVENTION

The present invention relates to an electrical connector for use at an end of a noise-prevention shielding cable. As shown in FIG. 13A, a shielding cable a is constituted by insulatingly-covered inner wires b, a braid wire c, made of a braided, narrow, electrically-conductive wire and provided around the inner wires b, and an outer insulating layer d covering the braid wire c. The electrically-conductive braid wire c shields electrical noise between the inner wires b and the exterior.

When such a shielding cable a is to be connected to a connector or the like, it is necessary to connect the insulatingly-covered inner wires b, as well as the braid wire c, to other electric wires. Conventionally, to achieve this connection, the end portion of the shielding cable has been processed in a manner shown in FIGS. 13A to 13E.

First, a predetermined length of the outer insulating layer d is removed from the end portion of the shielding cable a, as shown in FIG. 13A. Then, as shown in FIG. 13B, a hole c' is formed in the braid wire c so as not to cut off the braid wire c. The insulatingly-covered wires are taken out through the hole c', as shown in FIG. 13C. Then, as shown in FIG. 13D, the braid wire c is twisted, and is connected to an insulated wire e through a terminal e' which is compressed for purposes of this connection. Finally, as shown in FIG. 13E, a tape f is wound around the thus processed end portion for insulating purposes. Thereafter, metal terminals are connected to the ends of the inner wires b and the wire e, and are received within a connector or the like, thus making connection to the mating wires.

In the above-described conventional structure, when the hole c' is to be formed in the braid wire c, there is a possibility that the braid wire c will be cut off. There also are other problems. For example, it is necessary to connect the braid wire c to the wire e, and to provide a special device for compressing the terminal e'. Further, the tape winding is a time-consuming procedure.

SUMMARY OF THE INVENTION

In view of the foregoing, it is an object of this invention to provide a connector, for use at an end of a shielding cable, which eliminates the possibility of cutting off the braid wire c, and which facilitates connection.

This object has been achieved by a connector for use at an end of a shielding cable having insulatingly-covered inner wires, an electrically-conductive braid wire covering the inner wires, and an outer insulating layer covering the braid wire. The inventive connector is constituted by a tubular body adapted to fit on the outer insulating layer, a tubular terminal, having a body portion and a connection portion, for connection to an external electric wire, the body portion cooperating with the tubular body to hold the braid wire, folded back at an end of the outer insulating layer, therebetween so that the folded braid wire is disposed in pressure contact with the body portion and the tubular body, and a tubular casing for receiving and retaining the tubular body and the tubular terminal.

The shielding cable and the tubular casing are engaged with each other in a water-tight manner via an elastic member, such as packing.

A connector according to a modified form of the invention is constituted by a tubular body adapted to fit on the outer insulating layer, a tubular terminal, having a body portion and a connection portion, for connection to an external electric wire, the body portion cooperating with the tubular body to hold the braid wire, exposed at an end of the outer insulating layer, therebetween in such a manner that the exposed braid wire is disposed in pressure contact with the body portion and the tubular body, and a tubular casing receiving the tubular body and the tubular terminal therein and retaining them.

Preferably, in this last embodiment, a junction between the tubular body, attached to the end of the shielding cable, and the tubular terminal is covered with a molded water-proof resin layer.

BRIEF DESCRIPTION OF THE DRAWINGS

FIG. 10A shows the condition in which the braid wire is neatly folded back in an opposite direction, and FIG. 10B shows the condition in which the braid wire is not folded back in an opposite direction, but is formed into a corrugated configuration;

DETAILED DESCRIPTION OF THE PREFERRED EMBODIMENTS

Figure 1:
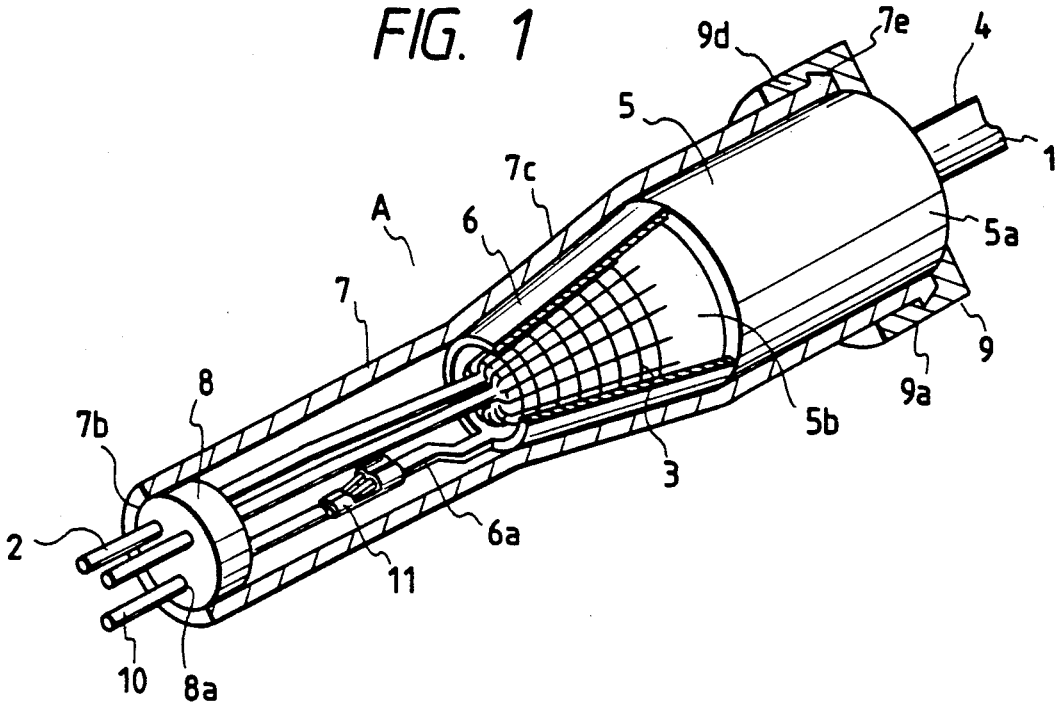
FIG. 1 is a partly-broken, perspective view of one embodiment of the present invention.

Preferred embodiments of the present invention now will be described with reference to the drawings. As shown in FIG. 1, a connector A for use at an end of a shielding cable, provided in accordance with the present invention, is constituted by a tubular body 5, an electrically-conductive tubular terminal 6, a tubular casing 7 covering the tubular body 5 and the tubular terminal 6, a water-prevention plug 8 fitted in the left end of the tubular casing 7, and a rear holder 9 fitted on the right end of the tubular casing 7. A terminal 11, attached to an end of an external electric wire 10 parallel to inner wires 2, is connected to a tab-like connection portion 6*a* formed integrally with the tubular terminal 6, so that the electric wire 10 is electrically connected to a braid wire 3.

Figure 2A:
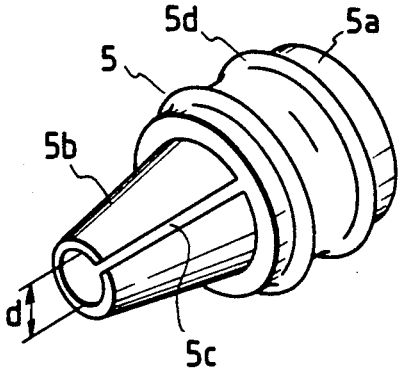
FIG. 2A is a perspective view of an elastic tubular body.
Figure 2B:
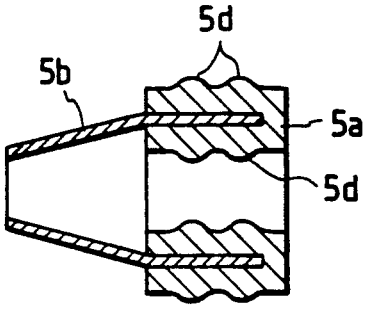
FIG. 2B is a longitudinal cross-sectional view of the tubular body.

As shown in FIGS. 2A and 2B, the tubular body 5 is constituted by a tubular base portion 5*a* of an elastic material such as silicone rubber, and an electrically-conductive cylindrical metal tube 5*b*, partially embedded in the base portion 5*a*, and having a tapered front portion and a slit 5*c*. A diameter d of the front end of the tapered portion of the tube 5*b* is slightly greater than an outer diameter of a shielding cable 1, so as to compensate for possible variations in thickness of the shielding cable 1. Ribs 5*d* are formed on each of the inner and outer surfaces of the base portion 5*a* so that the base portion 5*a* can fit water-tightly on an outer insulating layer 4, and also can fit water-tightly in the tubular casing 7.

Figure 3:
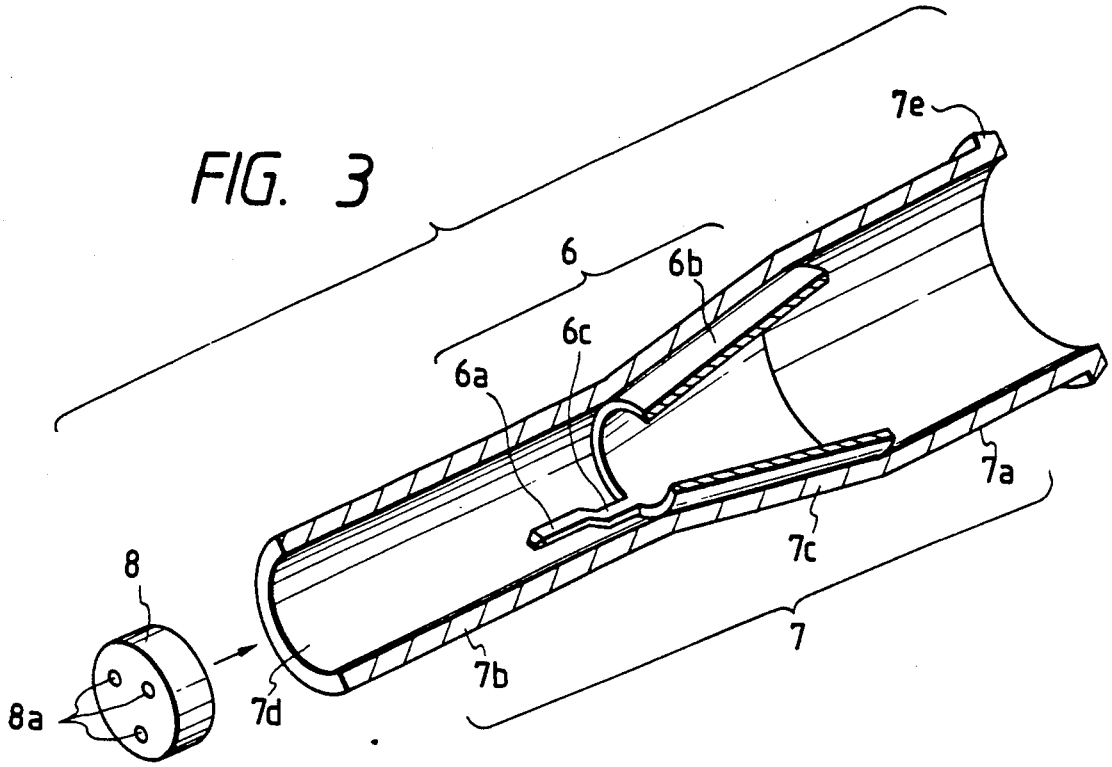
FIG. 3 is a partly sectional exploded perspective view, showing an electrically-conductive tubular terminal, a tubular casing and a water-prevention plug.

As shown in FIG. 3, the tubular terminal 6 is made of an electrically-conductive material such as metal, and includes a body portion 6*b* which is tapered as in the electrically-conductive tube 5*b*. A tab-like connection portion 6*a* extends integrally from the body portion 6*b* through a bus bar 6*c*. The body portion 6*b* may have a slit similar to the slit 5*c* of the electrically-conductive tube 5*b*. In that case, the inner diameter of the body portion 6*b* is slightly smaller than the diameter of the electrically-conductive tube 5*b* so that the body portion 6*b* can be in pressure contact with the electrically-conductive tube 5*b* by its own resiliency.

The tubular casing 7, which is made of an electrically-insulative synthetic resin or the like, includes a right cylindrical portion 7*a* of a greater diameter (FIG. 3) fitted on the base portion 5*a* of the tubular body 5, a left cylindrical portion 7*b* of a smaller diameter, and an intermediate tapered portion 7*c* which interconnects the cylindrical portions 7*a* and 7*b* and corresponds in shape to the body portion 6*b* of the tubular terminal 6. A water-prevention plug 8 is fitted into a left open end 7*d* of the tubular casing 7, and the elastic tubular body 5 is fitted into the tubular casing 7 from the right end thereof. Thereafter, the rear holder 9 is fitted on the tubular casing 7.

As shown in FIG. 3, the water-prevention plug 8 is made of an elastic material such as silicone rubber, as is the tubular body 5, and has a disk or cylindrical shape. The water-prevention plug 8 seals the left open end 7*d* of the smaller-diameter cylindrical portion 7*b* in a water-tight manner. A plurality of holes 8*a* are formed through the water-prevention plug 8. The inner wires 2 and the external wire 10, respectively, pass in water-tight fashion through the holes 8*a*.

Figure 4:
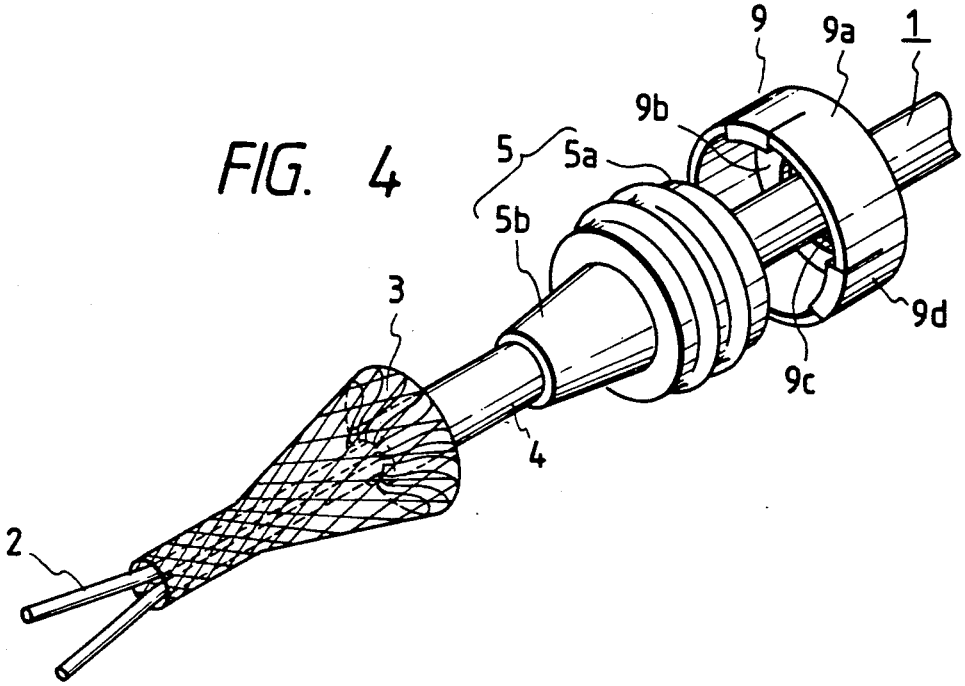
FIG. 4 is a perspective view of the connector of the present invention at an intermediate stage of assembly.

As shown in FIG. 4, the rear holder 9 has a short cylindrical portion 9*a* and a bottom portion 9*b* formed on one end of the cylindrical portion 9*a*. The bottom portion 9*b* has a hole 9*c* through which the shielding cable 1 passes. As shown in FIG. 1, the cylindrical portion 9*a* is fitted on the right end of the tubular casing 7. Retainer portions 9*d* are engaged with a retainer projection 7*e* (FIG. 3) formed on the outer periphery of the cylindrical portion 7*a*, thereby fixing the tubular casing 7 and the elastic tubular body 5 to each other. At this time, the tubular casing 7 fits on the elastic tubular body 5 in a water-tight manner through the ribs 5*d* formed on the elastic tubular body 5.

The assembly of the inventive connector now will be described with reference to FIG. 1, this description being merely illustrative, not limiting. First, the shielding cable 1 is passed through the base portion 5*a* of the tubular body 5. A suitable length of the outer insulating layer 4 is removed from the end portion of the shielding cable 1 to expose the braid wire 3. The braid wire 3 is folded back to be fitted on the tapered electrically-conductive tube 5*b*. Then, the tapered body portion 6*b* of the tubular terminal 6 is fitted on the braid wire 3 which in turn is fitted on the electrically-conductive tube 5*b*. Thereafter, the mating terminal 11 attached to the end of the external wire 10 is fitted on the tab-like connection portion 6*a* formed on the electrically-conductive tubular terminal 6, so that the braid wire 3 is connected to the external wire 10 via the tubular terminal 6. Then, the tubular casing 7 is fitted on the thus assembled members, and the rear holder 9 is fitted on the greater-diameter cylindrical portion 7*a* of the tubular casing 7. As a result, the tapered portion 7*c* of the tubular casing 7 is fitted on the tapered body portion 6*b* of the electrically-conductive tubular terminal 6, so that the tubular terminal 6 is held in pressure contact with the electrically-conductive tube 5*b*, thereby making the connection positive between the braid wire 3 and the external wire 10.

At the same time, the tubular terminal 6 is retained within the tubular casing 7. On the other hand, the two inner wires 2 and the external wire 10 are projected outwardly from the left open end 7*d* of the smaller-diameter cylindrical portion 7*b* of the tubular casing 7, and the water-prevention plug 8, through which the external wire 10 and the inner wires 2 are passed beforehand, is fitted in the left end of the smaller-diameter cylindrical portion 7*b*.

After the connector A is assembled, metal terminals (not shown) are attached respectively to the distal ends of the inner wires 2 and the external wire 10 projected from the water-prevention plug 8, are received in another connector or the like, and are connected to mating electric wires or the like.

Figure 5:
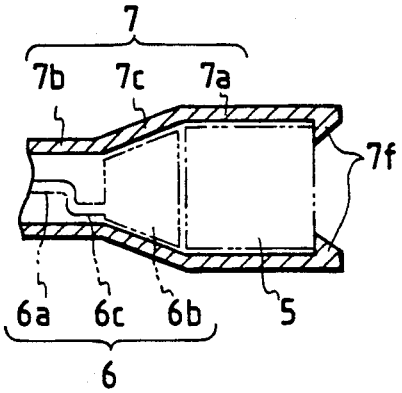
FIG. 5 is a longitudinal cross-sectional view of another embodiment not employing a rear holder.

FIG. 5 shows another embodiment in which the rear holder 9 is not used. A retainer projection 7*f* is formed on an end of a greater-diameter cylindrical portion 7*a* of a tubular casing 7, and is directed radially inwardly of this cylindrical portion. The tubular body 5 is retained directly by the retainer projection 7*f*. With this construction, the number of the component parts is reduced, and the cost can be reduced accordingly. Further, by not using a rear holder 9 having a large diameter, the outer diameter of the connector A can be reduced.

Figure 6:
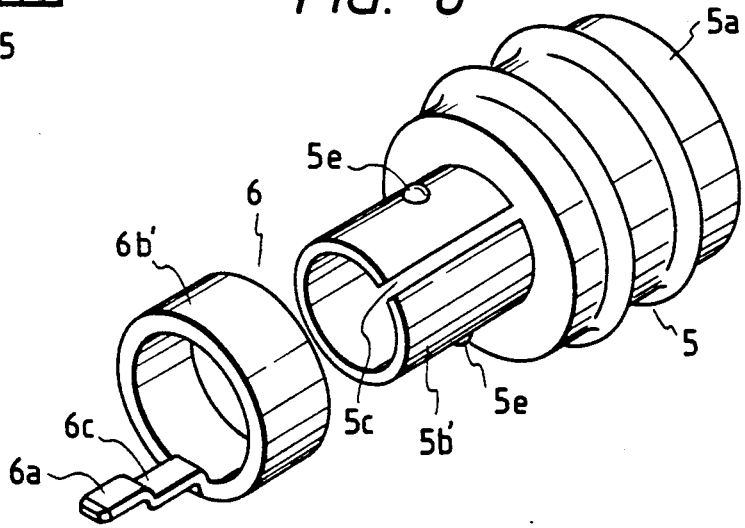
FIG. 6 is an exploded perspective view of a further embodiment having no tapered surface, showing an elastic tubular body and an electrically-conductive tubular terminal.
Figure 7:
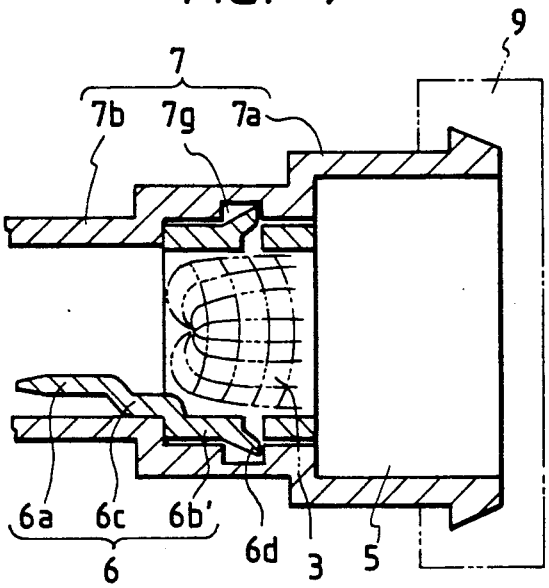
FIG. 7 is a longitudinal cross-sectional view of an important portion of the embodiment having no tapered surface.

FIG. 6 shows another embodiment in which the pressure contact of the braid wire 3 is carried out without the use of a tapered surface. In this embodiment, an electrically-conductive tube 5*b*′ formed on a tubular body 5 is constituted by a straight cylinder having no tapered portion, and similarly its mating body portion 6*b*′ of a tubular terminal 6 is constituted by a straight cylinder. A tubular casing 7 also lacks a tapered surface, as shown in FIG. 7. The body portion 6*b*′ of the tubular terminal 6 is fitted on the electrically-conductive tube 5*b*′ through projections 5*e* formed on the tube 5*b*′, and the body portion 6*b*′ of the tubular terminal 6 is fitted on the electrically-conductive tube 5*b*′, with the braid wire 3 interposed therebetween. A retainer hole 7*g* is formed in the inner surface of the tubular casing 7 in which the tubular terminal 6 is received. Projecting portions 6*d*, formed on the body portion 6*b'*, are engaged in the retainer hole 7*g* to retain the tubular terminal 6 in the tubular casing 7. A slit similar to the slit 5*c* shown in FIG. 2A may be formed in the body portion 6*b'* of the tubular terminal 6. In that event, because of the resiliency of the body portion 6*b'*, the body portion 6*b'* is in pressure contact with the electrically-conductive tube 5*b'* via the braid wire 3, and a gap is formed between the inner periphery of the tubular casing 7 and the tubular terminal 6. With the above construction, there is no need to provide any tapered surface, and therefore the formation of each part can be made more easily.

Figure 8:
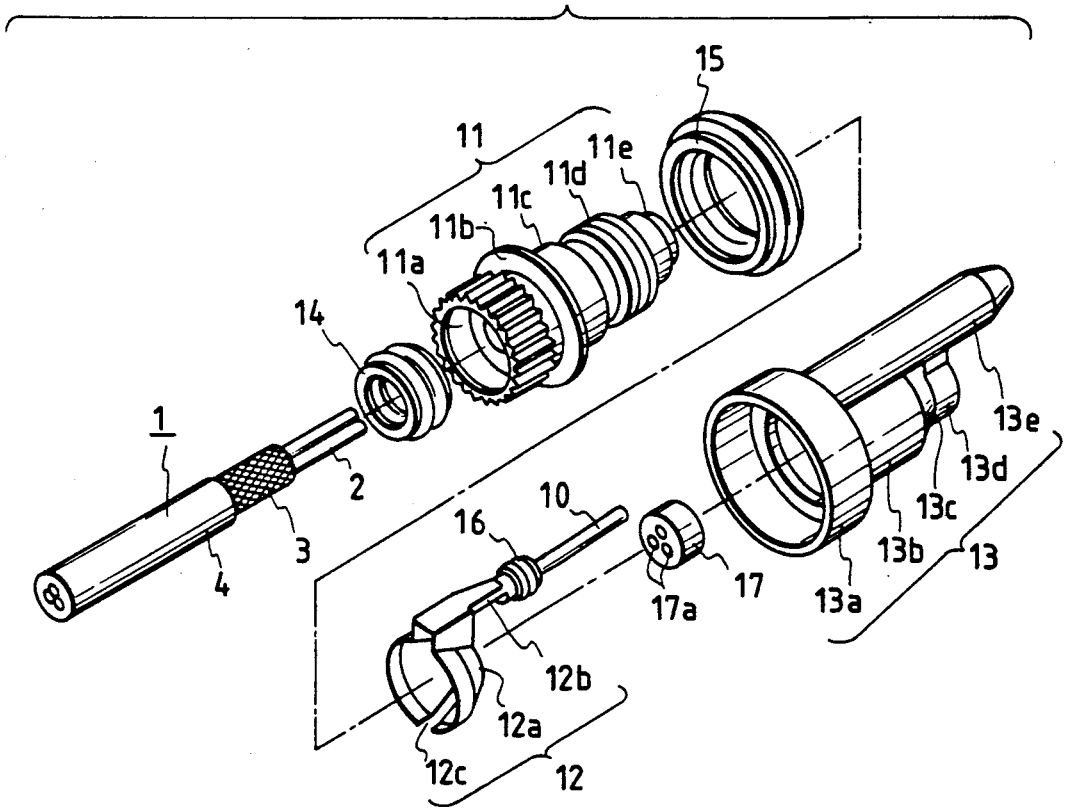
FIG. 8 is an exploded perspective view of a further embodiment in which a tubular body is threadedly engaged with a tubular casing.
Figure 9:
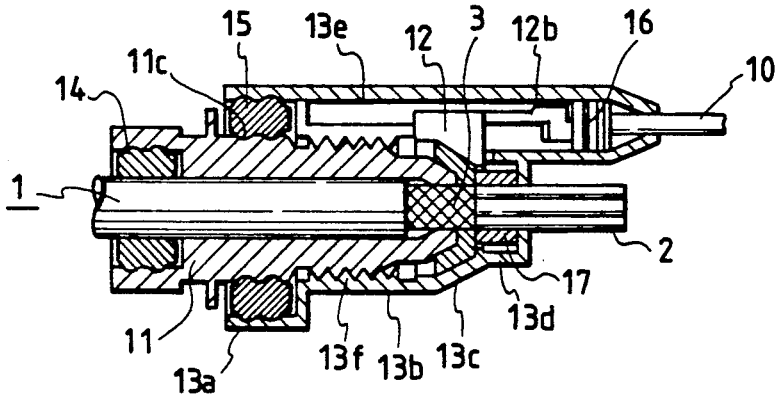
FIG. 9 is a longitudinal cross-sectional view of the embodiment of FIG. 8 after the assembly thereof.

FIGS. 8 and 9 show a further embodiment. A connector for use at an end of a shielding cable, shown in these Figures, is constituted by a tubular body 11, an electrically-conductive tubular terminal 12, a tubular casing 13, packings 14 and 15, and water-prevention plug 16 and 17. These packings and water-prevention plugs serve to engage the component parts with one another in a water-tight manner.

The tubular body 11 corresponds to the tubular body 5 of the embodiment shown in FIG. 1. A shielding cable 1 is passed through the tubular body 11. The tubular body 11 has a gear-shaped outer wall at its shielding cable insertion side (shown in the drawings). The interior of this gear-shaped outer wall defines a water-prevention space 11*a* for receiving the packing. The tubular body 11 includes a flange portion 11*b*, a cylindrical portion 11*c*, a threaded portion 11*d* and a tapered surface 11*e* which are arranged sequentially in this order from the water-prevention space 11*a*.

The tubular terminal 12 generally is similar to the tubular terminal 6 of the embodiment shown in FIG. 1, and is made of an electrically-conductive material such as a thin metal sheet. The tubular terminal 12 includes an annular body portion 12*a* having a tapered configuration similar to the tapered surface 11*e* of the tubular body 11, and a wire connection portion 12*b* extending from the annular body portion 12*a*. The body portion 12 a has a slit 12*c* by which the body portion 12*a* can accommodate a difference in diameter of a braid wire 3 with which the body portion 12*a* is to be in pressure contact. An external electric wire 10 is connected by pressing to the connection portion 12*b*.

The tubular casing 13, which corresponds to the tubular casing 7 of the embodiment shown in FIG. 1, receives the tubular body 11 and the tubular terminal 12 therein. The tubular casing 13 includes a greater-diameter portion 13*a* at the lower left of the drawings, an intermediate portion 13*b*, a tapered portion 13*c*, and a smaller-diameter portion 13*d*, the portions 13*b*, 13*c*, and 13*d* being arranged in this order. Further, a terminal receiving portion 3*e*, having an open end which is open to the interior of the greater-diameter portion 13*a*, is formed along one side of the tubular casing 13, and is projected right above the smaller-diameter portion 13*d*. The distal end portion of the terminal receiving portion 13*e* is tapered. An internally-threaded portion 13*f*, formed on the inner surface of the intermediate portion 13*b*, is engaged threadedly with the threaded portion 11*d* formed on the tubular body 11.

Packing 14 is interposed between the shielding cable 1 and the water prevention space 11*a* of the tubular body 11. Packing 15 is interposed between the cylindrical portion 11*c* of the tubular body 11 and the greater-diameter portion 13*a* of the tubular casing. The external wire 10 is passed in a water-tight manner through the terminal receiving portion 13*e* via the water prevention plug 16. The inner wires 2 of the shielding cable 1 are passed in a water-tight manner through respective holes 17*a* of the water prevention plug 17, and are received in the smaller-diameter portion 13*d* of the tubular casing 13. The packings 14 and 15 and the water prevention plus 16 and 17 provide water-tight seals between the parts provided between the shielding cable 1 and the tubular casing 13.

One example of the order of assembly of the above connector will now be described with reference to FIGS. 8 and 9. First, an insulating covering 4 is removed from the end portion of the shielding cable 1 to expose the inner wires 2 and the braid wire 3. In this condition, the shielding cable 1 is passed through the packing 14 and the tubular body 11. After the end portion of the shielding cable 1 is passed through the tubular body 11, the braid wire 3 is expanded and is fitted on the tapered surface 11*e*, and the packing 15 is fitted on the cylindrical portion 11*c*. The external wire 10 is press-connected beforehand to the connection portion 12*b* of the tubular terminal 12. The water prevention plug 16 is attached beforehand to the external wire 10. The tubular terminal 12 is attached to the tubular body 11 in such a manner that the body portion 12*a* covers the tapered portion 11*e* on which the braid wire 3 fits. The water prevention plug 17 is fitted on the end portions of the inner wires 2, thus retaining the tubular terminal 12 provisionally on the tubular body 11.

Then, the external wire 10 is passed through the terminal receiving portion 13*e*, and at the same time the inner wires 2 passed through the tubular body 11 and the water prevention plug 17 are passed through the tubular casing 13. In this manner, the ends of these wires are projected outwardly from the connector. Further, the tubular body 11 is rotated and is inserted into the tubular casing 13, so that the externally-threaded portion 11*d* is engaged threadedly with the internally-threaded portion 13*f*, thereby clamping the braid wire 3 between the body portion 12*a* of the tubular terminal 12 and the tapered surface 11*e*. The smaller-diameter portion 13*d* of the tubular casing 13 is closed by the water prevention plug 17, and the distal end portion of the terminal receiving portion 13*e* is closed by the water prevention plug 16.

At this time, the external wire 10 and the inner wires 2 are pulled from the side (upper right side in the drawings) of the terminal receiving portion so as to eliminate the loosening of these wires. Thus, the braid wire 3 is connected electrically to the external wire 10 via the tubular terminal 12 and the connection portion 12*a*, as shown in FIG. 9. Finally, the packing 14 is forced into the water prevention space 11*a* provided at the rear end of the tubular body 11, thus completing the assembly operation. In this manner, the end portion of the shielding cable 1 is connected to the connector in a water-tight fashion, and the tubular body 11 and the tubular casing 13 can be connected together firmly by the threaded connection. Thereafter, the inner wires 2 and the external wire 10 are connected to another connector, and are connected to their respective mating electric wires.

Figure 10A:
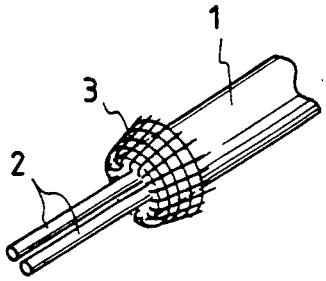
FIGS. 10A and 10B show the condition of processing of an end portion of a braid wire.
Figure 10B:
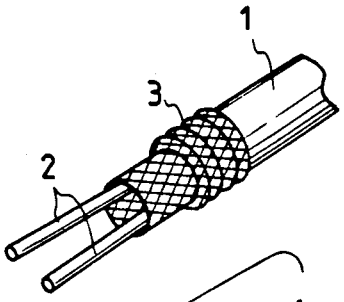

Incidentally, in each of the above embodiments, it is important that the braid wire 3 exposed at the end portion of the shielding cable 1 be folded back neatly in an opposite direction, as shown in FIG. 10A. However, this operation is rather difficult, and the exposed braid wire is liable to be corrugated, as shown in FIG. 10B. If the exposed braid wire becomes corrugated, the tubular terminal 6 cannot be fitted satisfactorily on the tubular body 5, which makes it very difficult to assemble the connector. In order to fold back the exposed braid wire 3 satisfactorily, it is better that the exposed braid wire 3 be short; however, in that case, a good electrical connection cannot be maintained. Further, in the above embodiments, the number of the component parts is relatively greater.

Figure 11:
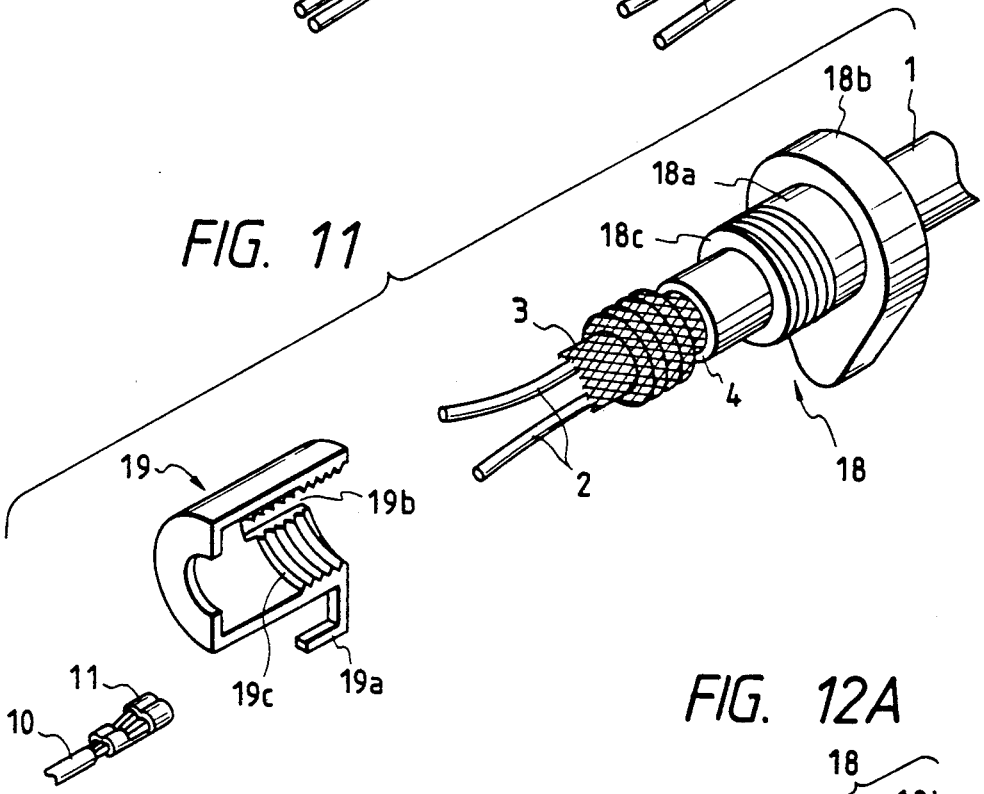
FIG. 11 is an exploded perspective view of a further embodiment of the invention, intended to reduce the number of component parts.
Figure 12A:
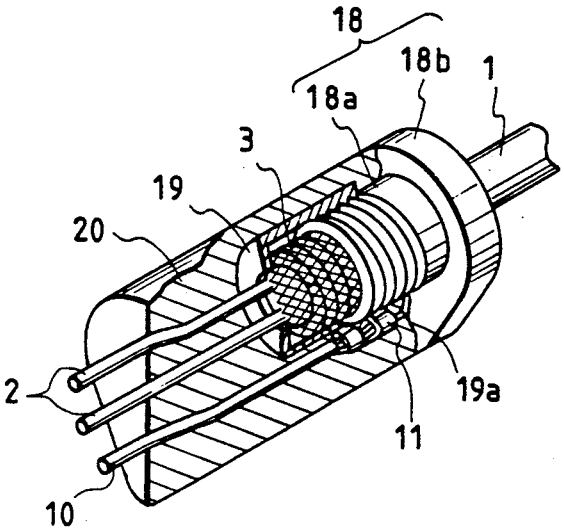
FIG. 12A is a partly-broken, perspective view of the connector of FIG. 11 provided with a resin layer.
Figure 12B:
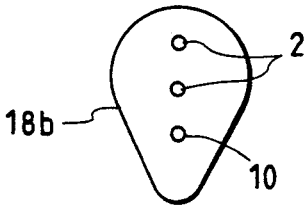
FIG. 12B is a left side-elevational view of the connector of FIG. 12A.
Figure 13A:
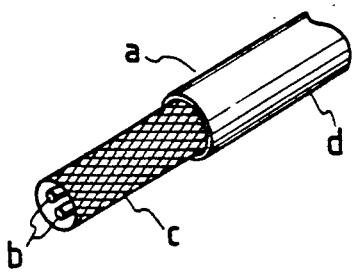
FIGS. 13A, 13B, 13C, 13D, 13E are views showing conventional steps of processing an end portion of a shielding cable.
Figure 13B:
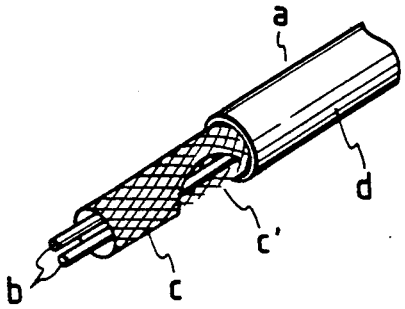
Figure 13C:
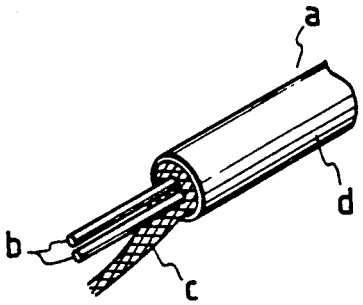
Figure 13D:
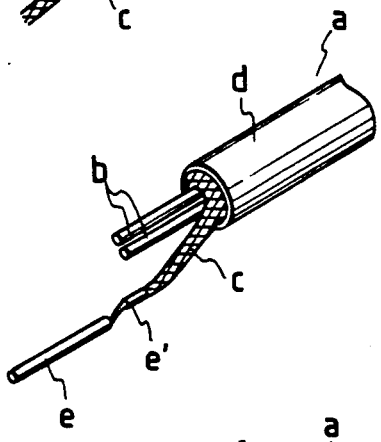
Figure 13E:
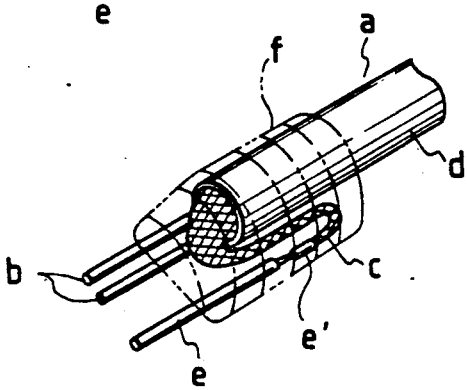

An embodiment shown in FIGS. 11 and 12 has been made in view of these last considerations. A connector for use at an end of a shielding cable, shown in these Figures, is constituted by a tubular body 18, an electrically-conductive tubular terminal 19, and a resin layer 20 molded to cover a junction between the tubular body 18 and the tubular terminal 19. The tubular casing, the water prevention plugs, the packings, etc., used in the above embodiments are not needed, thus greatly reducing the number of the component parts.

More specifically, the tubular body 18 corresponds to the tubular body 5 of FIG. 1. The shielding cable is adapted to be passed through the tubular body 18. The tubular body 18 includes a tubular portion 18*a* having no tapered portion, and an oval-shaped flange 18*b* formed integrally with the tubular portion 18*a*. External threads 18*c* are formed on the distal end portion of the tubular portion 18*a*. The flange 18*b* is not essential, and so can be omitted. Although the materials for the tubular portion 18*a* and the flange 18*b* may be either electrically conductive or electrically insulative, the flange 18*b* is electrically insulated from the tubular portion 18*a*, because the flange 18*b* is exposed to the exterior. Further, the material for the flange 18*b* is required to be heat-resistant because the resin layer 20 is molded thereon. The material for the flange 18*b* also is required to provide a seal between the flange 18*b* and the shielding cable.

The tubular terminal 19, corresponding to the tubular terminal 6 of FIG. 1, is constituted by a cylinder of electrically-conductive metal, though a split half thereof is shown in the drawings to show the interior thereof. The tubular terminal 19 has a bus bar-like connection portion 19*a* formed integrally therewith, and has a slit 19*b* so that it can threadedly engage the tubular portion 18*a* of the tubular body 18 in a versatile manner. The tubular terminal 19 further has internal threads 19*c* for threaded engagement with the external threads 18*c*.

One example of the assembly of this embodiment now will be described. First, the tubular body 18 is fitted on the end portion of the shielding cable 1, and an outer insulating layer 4 is removed from the end portion of the shielding cable 1 to expose inner wires 2 and a braid wire 3. The tubular body 18 is moved near the end of the outer insulating layer 4, and the braid wire 3 is urged into a corrugated configuration without being folded back. The tubular terminal 19 is fitted on the inner wires 2 from the ends of the inner wires 2, and the internal threads 19*c* are engaged threadedly with the external threads 18*c* of the tubular body 18. At this time, the corrugated braid wire 3 is clamped firmly between the tubular body 18 and the tubular terminal 19, so that the braid wire 3 positively can be connected electrically to the electrically-conductive tubular terminal 19. Then, a terminal 11 of an external wire 10 is fitted on the connection portion 19*a* of the tubular terminal 19.

If the connector is installed at a place where the junction is not affected by moisture or water, the assembly operation is completed with the above procedure, and the junction is covered by tape or the like to such a degree that one will not receive an electrical shock therefrom.

However, if the connector is installed at a place where the junction can be affected by moisture or water, covering only with tape or the like will not be adequate. Therefore, after the above procedure, the junction between the tubular body 18 and the tubular terminal 19 is covered by a mold (not shown), and the resin layer 20 is formed by molding so as to provide positive waterproofness.

In this embodiment, the braid wire 3 does not need to be folded back, but needs only to be displaced into a corrugated configuration. Therefore, the processing of the braid wire is easy, thus enhancing the efficiency of the operation. Further, the number of the component parts can be reduced, thus reducing the cost. Still further, when the junction is covered by the molded resin layer, other effects such as the waterproofness can be achieved.

In this embodiment, the braid wire 3 does not need to be folded back, but is not prohibited from being folded back. The connection between the tubular body 18 and the tubular terminal 19 only is required to provide a stable electrical connection, and therefore the connection between them is not limited to the threaded connection.

As described above, according to the present invention, there is no possibility of damaging the braid wire, and the tape winding operation is not necessary. Therefore, the end portion of the shielding cable can be attached easily to the connector. Also, by providing a water prevention plug or a molded resin layer, the connector can be used as a water-proof connector. Further, when the resin layer is formed by molding, particular effects, such as an easier operation and a reduced number of the component parts, can be achieved.

While the invention has been described in detail above with reference to a preferred embodiment, various modifications within the scope and spirit of the invention will be apparent to people of working skill in this technological field. Thus, the invention should be considered as limited only by the scope of the appended claims.

What is claimed is:

1. An electrical connector for use at an end of a shielding cable having insulatingly-covered inner wires, an electrically-conductive braid wire covering said inner wires, and an outer insulating layer covering said braid wire, said connector comprising:

a tubular body adapted to fit on said outer insulating layer;

a tubular terminal, having a body portion and a connection portion, for connection to an external electric wire, said body portion cooperating with said tubular body to hold said braid wire, folded back at an end of said outer insulating layer, therebetween in such a manner that said folded braid wire is disposed in pressure contact with said body portion and said tubular body; and a tubular casing receiving and retaining said tubular body and said tubular terminal wherein said tubular body includes a flange portion, a cylindrical portion, a threaded portion, and a tapered surface, arranged sequentially and said tubular terminal includes a tapered annular body portion corresponding to said tapered surface, and a wire connection portion extending from said tapered annular body portion.

2. An electrical connector according to claim 1, wherein said tubular casing has through holes for said inner wires and said external electric wire, respectively.

* * * * *